US009657475B1

(12) United States Patent
Steele

(10) Patent No.: US 9,657,475 B1
(45) Date of Patent: May 23, 2017

(54) SUSPENDED CEILING UNIT

(71) Applicant: SIMPLEX STRIP DOORS, LLC, Fontana, CA (US)

(72) Inventor: Jason Steele, Rancho Cucamonga, CA (US)

(73) Assignee: SIMPLEX STRIP DOORS, LLC, Fontana, CA (US)

( * ) Notice: Subject to any disclaimer, the term of this patent is extended or adjusted under 35 U.S.C. 154(b) by 0 days.

(21) Appl. No.: 15/044,239

(22) Filed: Feb. 16, 2016

(51) Int. Cl.

| | |
|---|---|
| ***E04B 9/10*** | (2006.01) |
| ***E04B 9/18*** | (2006.01) |
| ***E04B 1/94*** | (2006.01) |
| ***E04B 9/00*** | (2006.01) |
| ***A62C 35/68*** | (2006.01) |

(52) U.S. Cl.
CPC ..... *E04B 1/941* (2013.01); *A62C 35/68* (2013.01); *E04B 9/003* (2013.01); *E04B 9/10* (2013.01); *E04B 2009/186* (2013.01)

(58) Field of Classification Search
CPC . E04B 1/941; E04B 9/003; E04B 9/10; E04B 2009/186; A62C 35/68
USPC ..... 52/506.06, 506.04, 506.03
See application file for complete search history.

(56) References Cited

U.S. PATENT DOCUMENTS 1,373,567 A * 4/1921 Overlien ..... E05F 17/004 292/341
1,722,670 A * 7/1929 Lewis ..... E05F 15/63 49/107
2,273,594 A * 2/1942 Rich ..... E05F 15/627 292/277
2,304,628 A * 12/1942 Damerel ..... F24F 7/10 454/108
6,467,228 B1 10/2002 Wendt et al.
6,533,656 B2 * 3/2003 Hertel ..... F24F 13/1406 454/259
6,840,329 B2 1/2005 Kikuchi et al.
8,628,158 B2 * 1/2014 Caveney ..... H05K 7/20745 312/204
9,066,450 B2 * 6/2015 Bednarcik ..... H05K 7/20745
9,103,117 B1 * 8/2015 Lundskog ..... H05K 7/1495
9,145,677 B2 * 9/2015 Wang ..... E04B 9/02
2001/0046838 A1 * 11/2001 Hertel ..... F24F 13/1406 454/259
2010/0000758 A1 * 1/2010 Bravo ..... H02G 3/16 174/60

(Continued)

*Primary Examiner* — Brent W Herring
(74) *Attorney, Agent, or Firm* — Kratz, Quintos & Hanson, LLP

(57) ABSTRACT

A drop panel unit of a suspended ceiling system, for preventing, in event of a fire, a suspended ceiling panel from interfering with a sprinkler system installed above the suspended ceiling system, the drop panel unit having a frame defining a drop panel opening and at least one drop panel for covering the drop panel opening. Each drop panel has a hinge for hinging the drop panel to one side of the frame, to provide for each drop panels to rotate about the hinge by gravity from a horizontal orientation to a vertical orientation. An electromagnetic support magnetically holds the drop panel in the horizontal orientation when electric power is provided to the electromagnetic support and a damper slows the rotation of the drop panel from the horizontal orientation to the vertical orientation when the electric power is removed from the electromagnetic support in the event of a fire.

4 Claims, 8 Drawing Sheets

(56) References Cited

U.S. PATENT DOCUMENTS

| | | | | |
|---|---|---|---|---|
| 2010/0144265 | A1* | 6/2010 | Bednarcikv | H05K 7/20745 454/184 |
| 2012/0181906 | A1* | 7/2012 | Caveney | H05K 7/20745 312/237 |
| 2015/0113883 | A1* | 4/2015 | Wang | E04B 9/02 52/1 |

* cited by examiner

SUSPENDED CEILING UNIT

BACKGROUND OF THE INVENTION

1. Field of the Invention

The present invention relates to suspended ceilings as found, for example, in cleanrooms, data centers, storerooms or any application wherein ceiling panels are suspended above a floor area of a building.

It is often desirable to have fire sprinkler protection for an area located beneath a suspended ceiling, and to have the fire sprinkler heads located above the ceiling panels of the suspended ceiling. This may be for sanitation and esthetic reasons, or, for example, for cases in which a suspended ceiling is installed in a building having an existing fire sprinkler system.

For the fire sprinkler system to be effective, it is necessary that the water or fire retardant discharged by the fire sprinkler system not be blocked in any way by a ceiling panel. It is necessary that the ceiling panel located beneath the fire sprinkler head be moved from the path of the water or fire retardant, in a rapid manner, when the fire sprinkler system is activated.

The present invention is a drop panel unit that takes the place of a ceiling panel, or a plurality of ceiling panels, of a suspended ceiling, and provides, in a rapid manner, an unobstructed path for the water or fire retardant discharged from the sprinkler head when the fire sprinkler system is activated.

2. Discussion of the Relevant Art

In order to provide a less obstructive and more aesthetical suspended ceiling, having a fire sprinkler system above the suspended ceiling for protecting the area beneath the suspended ceiling, U.S. Pat. No. 6,840,329 discloses a decorative cover plate secured to a housing in which operative parts of the sprinkler system are contained. The decorative plate is located substantially flush with the surface of the suspended ceiling with the housing disposed above the suspended ceiling. A fusible material is used to support the decorative plate and in the event of a fire in the area beneath the suspended ceiling, heat from the fire melts the fusible material thus releasing the decorative plate to expose a sprinkler head of the sprinkler system.

U.S. Pat. No. 6,467,228 discloses a hinged ceiling panel that is pivotally attached to a suspended ceiling grid structure. Unlike the present invention, the hinged ceiling panel must be manually released at the non-hinged edge in order to move the ceiling panel from the horizontal orientation to the vertical orientation. No mechanism is provided for moving the ceiling panel in the event of a fire or activation of a fire sprinkler system and no automatic means is provided to control the rotation of the ceiling panel from the horizontal orientation to the vertical orientation

SUMMARY OF THE INVENTION

The present invention is for use in a suspended ceiling system. The present invention is a drop panel unit having: a frame defining a drop panel opening; at least one pair of drop panels, each pair of drop panels comprising a first drop panel and a second drop panel, the at least one pair of drop panels having combined dimensions for completely covering the drop panel opening, each first and second drop panel having a hinge along one edge for hinging the first drop panel to one side of the frame and each second drop panel to the opposing side of the frame, to provide for the drop panels to rotate about the hinge by gravity from a horizontal orientation to a vertical orientation; a mounting beam extending between opposing sides of the frame; an electromagnetic support disposed between at least one of the first and second drop panels and the mounting beam to magnetically hold the first and second drop panels in the horizontal orientation when electric power is provided to the electromagnetic support; and a damper disposed between each drop panel and the mounting beam to slow the rotation of the drop panels from the horizontal orientation to the vertical orientation when electric power to the electromagnetic support is removed.

DETAILED DESCRIPTION OF THE PREFERRED EMBODIMENT

The present invention is a drop panel unit for use with a suspended ceiling. The drop panel unit may be used with any type of suspended ceiling ranging from those having a lighter duty inverted T grid system, as used in residential or commercial applications, to more robust grid systems found in data centers and cleanrooms used in the fields of semiconductors, bioscience, aerospace, pharmaceuticals, medicine, and food processing. The above listing of uses provides only some examples of possible uses as the drop panel unit of the invention is suited for any use where a fire sprinkler system is installed above a suspended ceiling.

Many installations having suspended ceilings, as described above, are required to have fire sprinkler protection to discharge water or a fire retardant to the area beneath the suspended ceiling. It is often desirable to have sprinkler heads of the fire sprinkler protection located above the suspended ceiling, to provide a ceiling free of obstructions in order to more easily maintain the space beneath the suspended ceiling in a contaminant-free condition, for example.

Having sprinkler heads located above the suspended ceiling requires that ceiling panels below the locations of the sprinkler heads be movable, in a rapid manner, in order that discharged water or fire retardant is not blocked from entering the space covered by the suspended ceiling. The drop panel unit of the present invention is a unit that can be used in place of a ceiling panel in a suspended ceiling installation, for rapidly moving ceiling panels to a position that does not interfere with the operation of the fire sprinkler protection.

Figure 1:
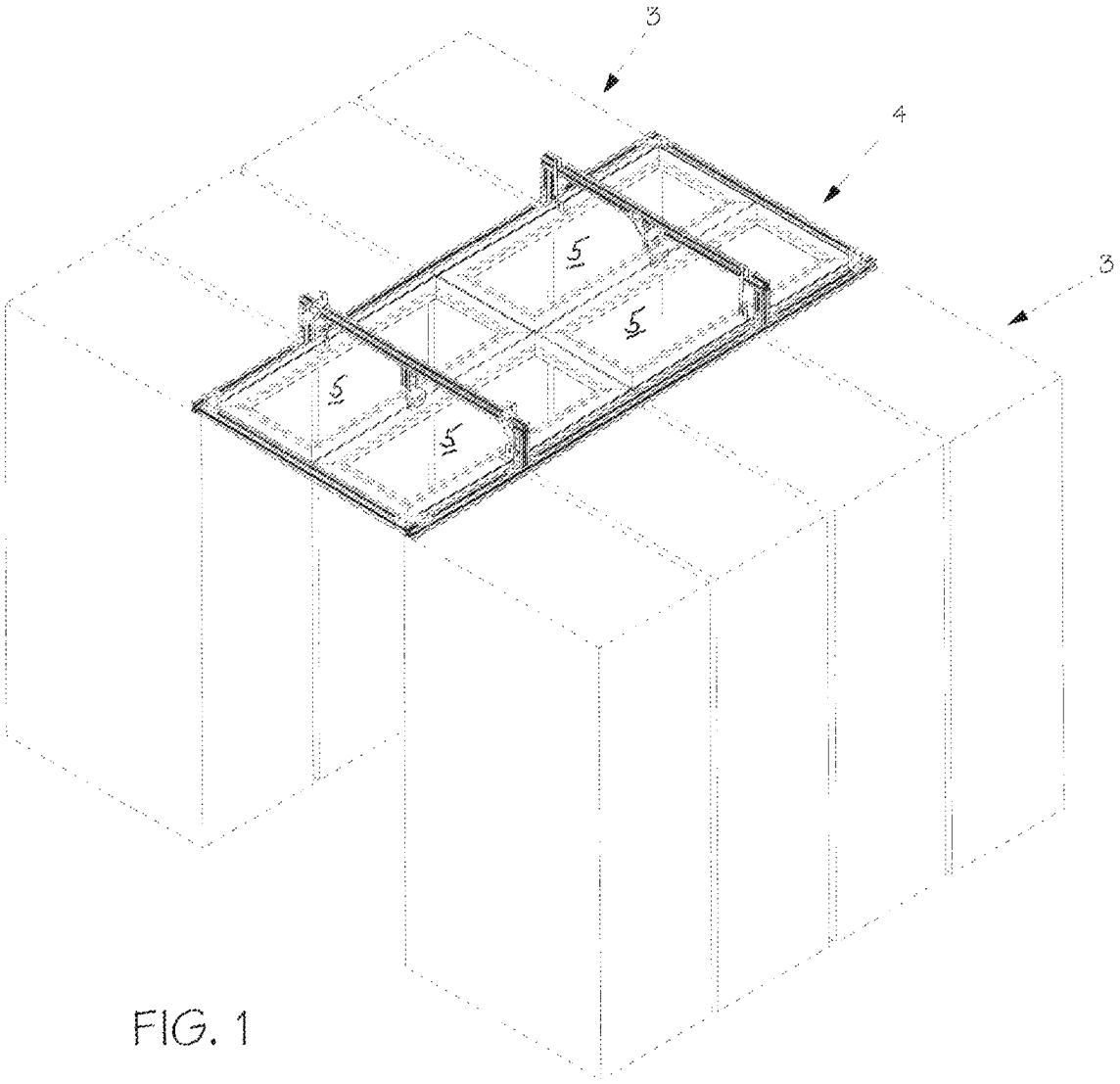
FIG. 1 is a perspective view of a drop panel unit of the invention installed between data center racks, and shown with drop panels of the drop panel unit having a horizontal orientation.
Figure 2:
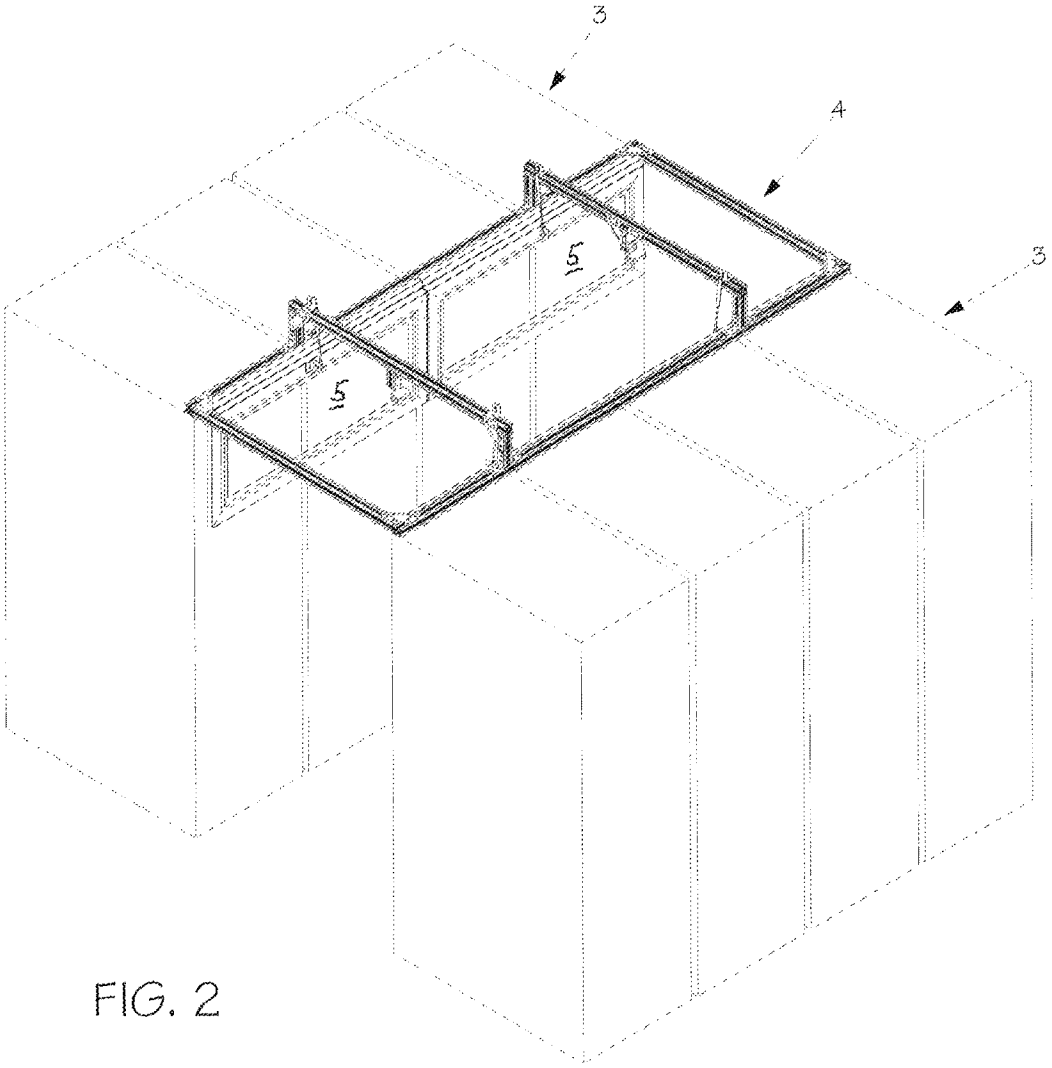
FIG. 2 is a perspective view of the drop panel unit of the invention installed between data center racks, and shown with the drop panels of the drop panel unit having a vertical orientation.

FIG. 1 is a perspective view of a drop panel unit of the invention installed between data center racks 3. The drop panel unit is indicated at 4 and it is shown with four drop panels 5 of the drop panel unit having a horizontal orientation. This is just one example of an installation of the drop panel unit of the invention. The drop panel unit can also be installed in a suspended ceiling made up of multiple lengthwise grid members and multiple crosswise grid members, which interlock to form a suspended ceiling grid system. This type grid system is typically suspended from the building structure in which it is located or in heavier duty grid systems, supported by sidewalls of a cleanroom structure or data center installation. In other situations the drop panel unit may not be suspended by a grid system but may be suspended by data center racks in a data center, as shown in FIGS. 1 and 2. The drop panel unit of the invention is a stand-alone unit and the particular manner of supporting the unit does not form a part of the invention. Other installations, not described above, are possible for installation of the invention.

FIG. 2 is a perspective view of a drop panel unit of the invention installed between data center racks 3, as in FIG. 1, however in FIG. 2 the drop panels 5 of the drop panel unit have a vertical orientation. In the drop panel unit of FIG. 2, only two of the drop panels 5 are visible.

Figure 3:
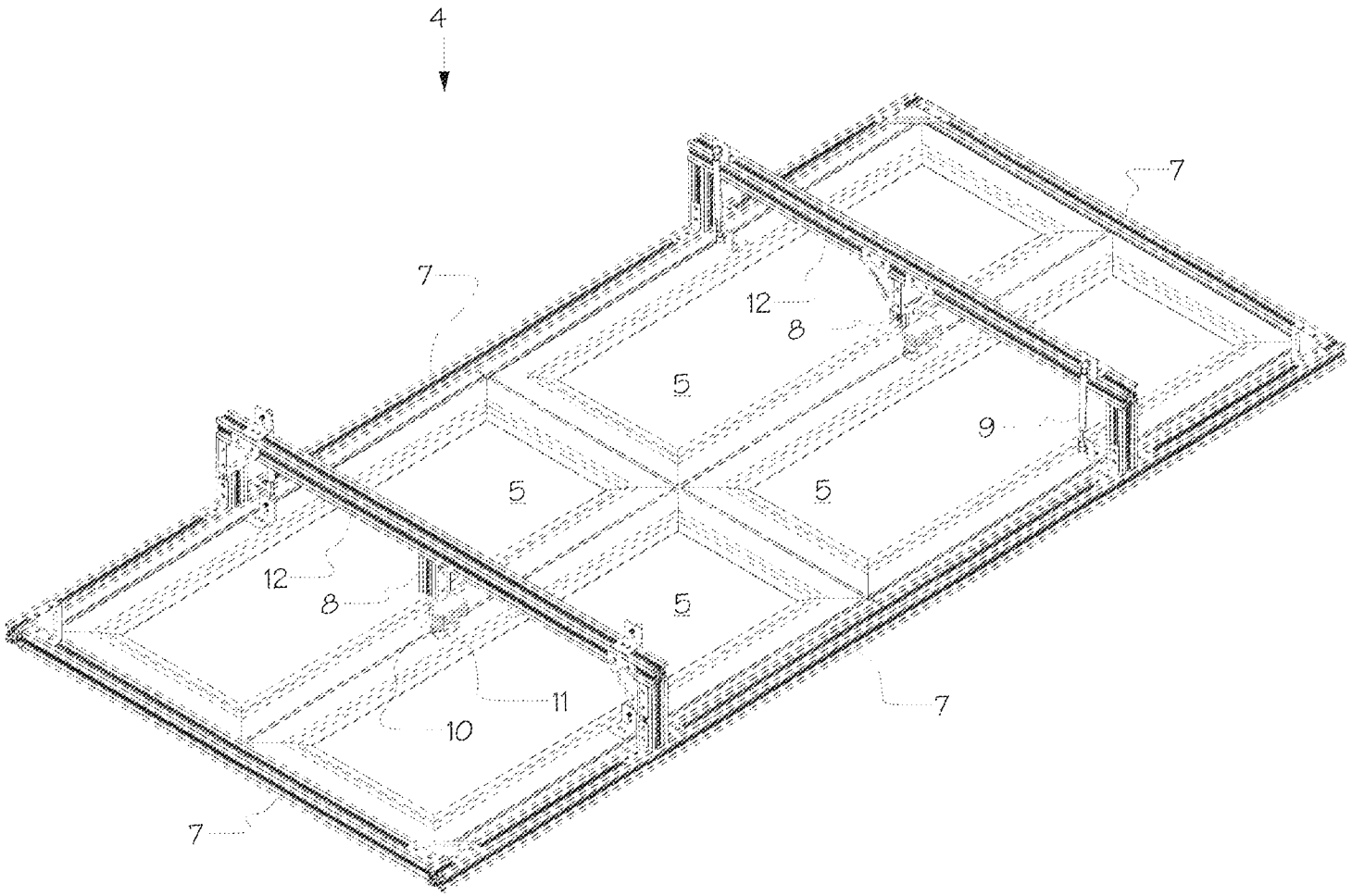
FIG. 3 is a perspective view of the drop panel unit of the invention in an installed orientation, as viewed from above the drop panel unit, and shown with the drop panels of the drop panel unit having a horizontal orientation.

FIG. 3 is a perspective view of the drop panel unit of the invention in an installed orientation, as viewed from above the drop panel unit, and shown with four drop panels 5 and the drop panels having a horizontal orientation. It is a function of the drop panel unit 4 to have the drop panels 5 rotate about hinges to the orientation shown in FIG. 4. The rotation must occur at the moment the fire sprinkler head is activated. It is important that drop panels 5, when rotated to the vertical orientation, not interfere with the operation of the fire sprinkler system.

Although the drawings show an embodiment having four drop panels 5 for covering an opening of the suspended ceiling, it is possible in practice of the invention to have more or less drop panels, including a single drop panel for covering an opening of a suspended ceiling.

As shown in FIGS. 2 through 7, components of the drop panel unit include a frame 7 defining a drop panel opening, electromagnetic support 8 and dampers 9. In the embodiment of FIGS. 1 through 7, four drop panels 5 provide complete coverage of the drop panel opening. Other drop panel configurations are possible and are discussed below. Each of the drop panels 5 is preferably hinged by hinges 13 to the frame 7 along sides of the frame having the longer dimension. However, hinging to the frame along sides of the frame having the shorter dimension is possible. Any type of hinge is possible in practice of the invention. For satisfactory performance of the unit, it is important that the hinges rotate freely, without binding or the like.

Figure 4:
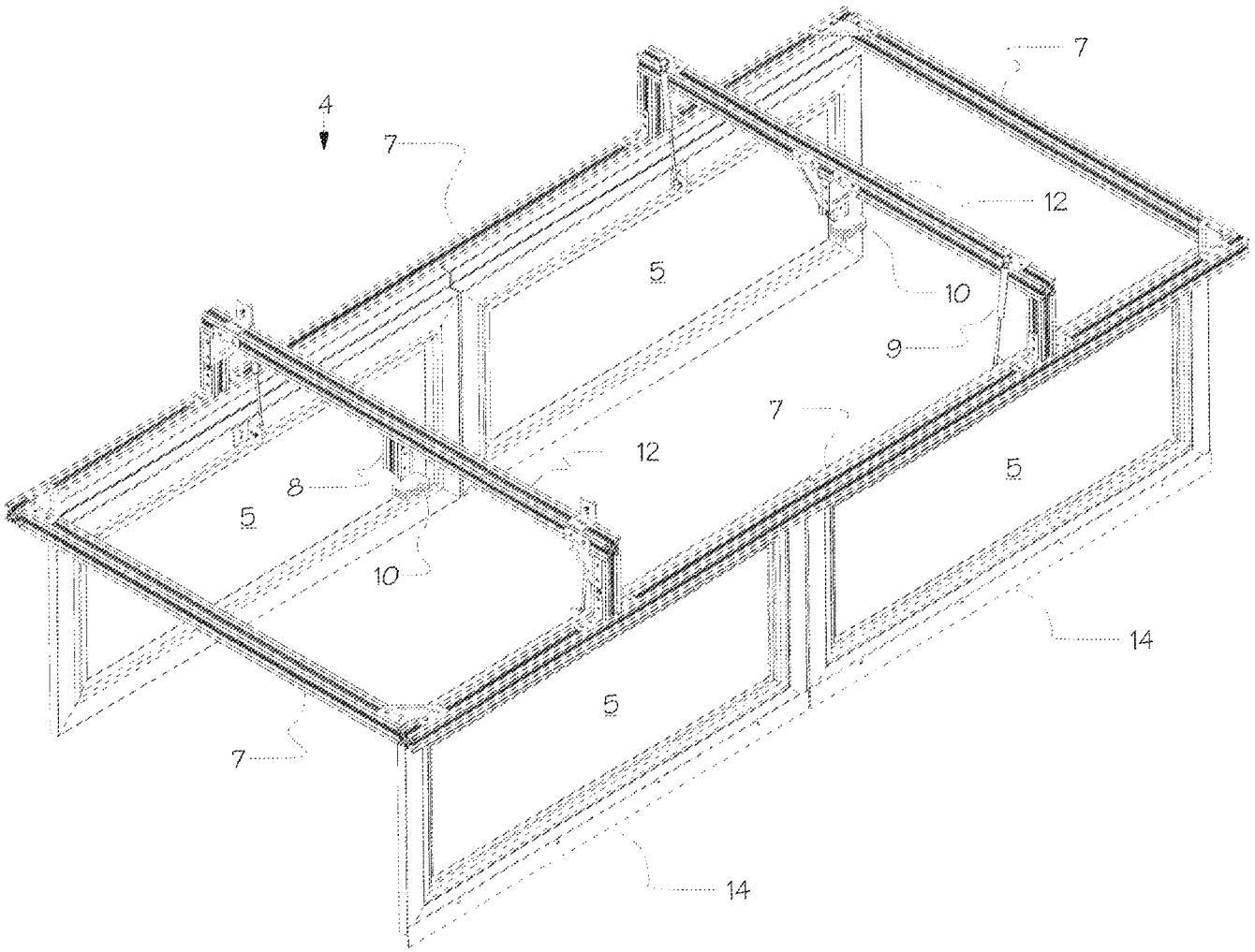
FIG. 4 is a perspective view of the drop panel unit of FIG. 3 in an installed orientation, as viewed from above the drop panel unit, and shown with the drop panels of the drop panel unit having a vertical orientation.

During periods when the fire sprinkler system is not activated the drop panels 5 of the unit are required to be in the horizontal orientation, as shown in FIGS. 1, 3, 5 and 6, in order to provide continuous ceiling coverage to the area beneath the suspended ceiling. However, the drop panels must drop to the vertical orientation, as shown in FIGS. 2, 4, and 7 if sprinkler heads located above the drop panel unit are activated. The electromagnetic support 8, disposed on at least one of the drop panels, holds the drop panel(s) in the horizontal orientation. The electromagnetic support 8 consists of an electromagnet 10 and a magnet contact plate 11 that is attached to the drop panel. The contact plate is attracted to the electromagnet when power is provided to the electromagnet. A mounting beam 12 is disposed above the drop panels for use in mounting the electromagnet 10 and the dampers 9. The magnet contact plate 11 is attached to the drop panel in a manner such that when the drop panel 5 is raised to the horizontal orientation, the magnet contact plate 11 aligns with the electromagnet 10. When electric power is provided to the electromagnet, the drop panel is held in the horizontal orientation. The electromagnet needs only to hold the drop panels against the force of gravity. In the event that fire protection is needed, the electric power to the electromagnet is removed when the associated fire protection system is activated.

In the embodiment shown in the figures only one electromagnet is used to hold two drop panels 5 in the horizontal orientation. One of the drop panels is provided with an overlapping molding 14 along the unhinged edge, as clearly shown in FIGS. 4 and 7, but hidden in the other figures. The overlapping molding holds the other drop panel in the horizontal orientation and also seals any gap between the drop panels. The two drop panels functioning in this manner are referred to in this application as a pair of drop panels and the individual drop panels are referred to as a first and a second drop panel of the pair. FIGS. 1 through 7 show drop panel units having two pairs of drop panels. As can be seen in the figures, all of the drop panels have a hinge and all of the first drop panels have a magnet contact plate 11 for aligning with the electromagnet 10. Also, all of the first drop panels have an overlapping molding 14 for holding second drop panels in the horizontal orientation.

In a preferred installation the electromagnetic support of the drop panel unit is electrically connected with the same fire-sensing device used for activating the fire sprinkler system. This arrangement is preferred in order that the drop panels are rotated out of the way at the same time the fire sprinkler system begins operation. Other means of removing electric power to the electromagnetic support are possible in practice of the invention.

In order for the drop panels to more smoothly drop from the horizontal orientation to the vertical orientation, each drop panel has a damper 9 having one end thereof attached to the drop panel and the other end attached to mounting beam 12. The dampers are provided in order to have the drop panels 5 rotate about the hinges 13 in a controlled manner when the fire sprinkler system is activated.

An additional feature of the drop panel unit, although not necessarily required, are seals disposed on the frame to contact the drop panels when in the horizontal orientation (not shown). The seals provide for better isolation of the area enclosed by the suspended ceiling.

Figure 5:
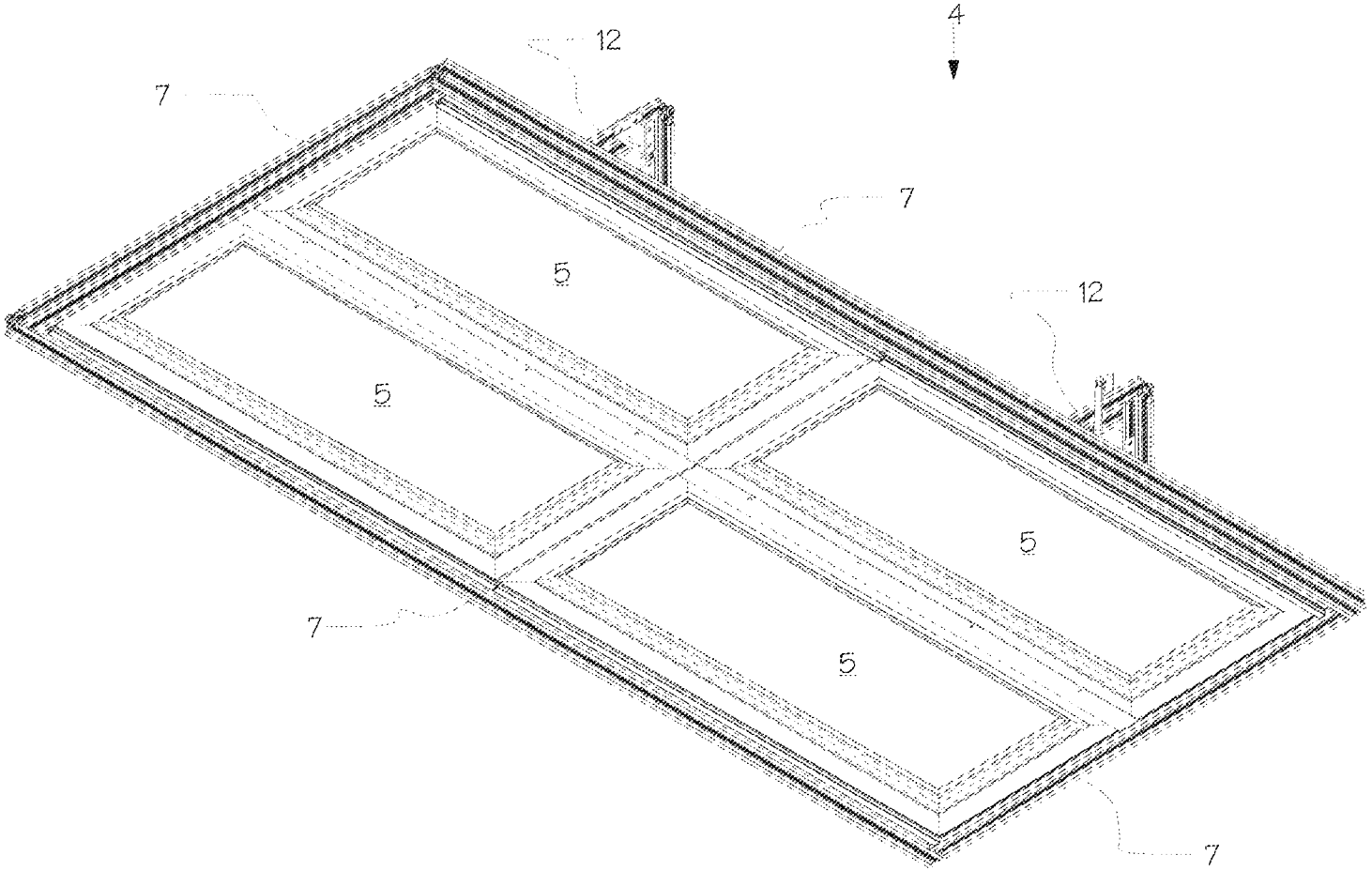
FIG. 5 is a perspective view of the drop panel unit of the invention in an installed orientation, as viewed from below the drop panel unit, and shown with the drop panels of the drop panel unit having a horizontal orientation.

FIG. 5 is a perspective view of the drop panel unit of the invention in an installed orientation, as viewed from below the drop panel unit, and shown with the drop panels of the drop panel unit having a horizontal orientation. In FIG. 5 the drop panel unit has four drop panels.

Figure 6:
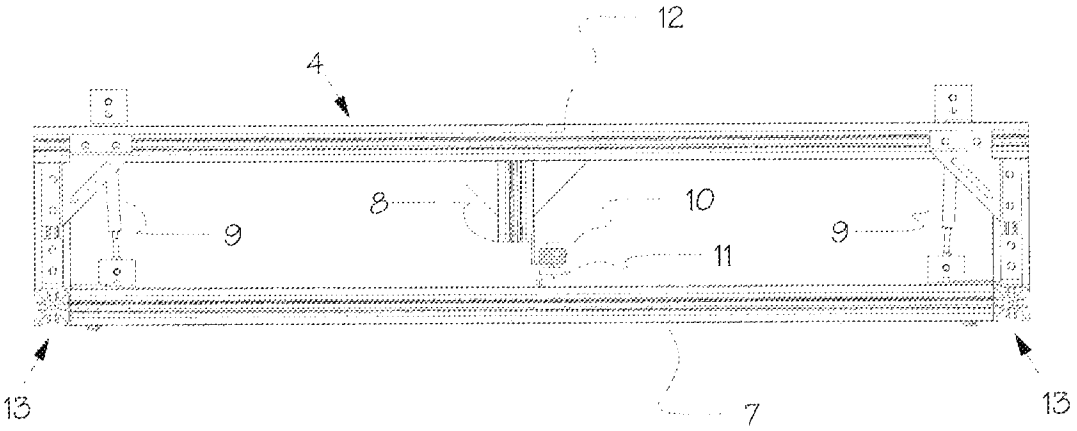
FIG. 6 is an end view of the drop panel unit of FIG. 5 in an installed orientation, and shown with the drop panels of the drop panel unit having a horizontal orientation.
Figure 7:
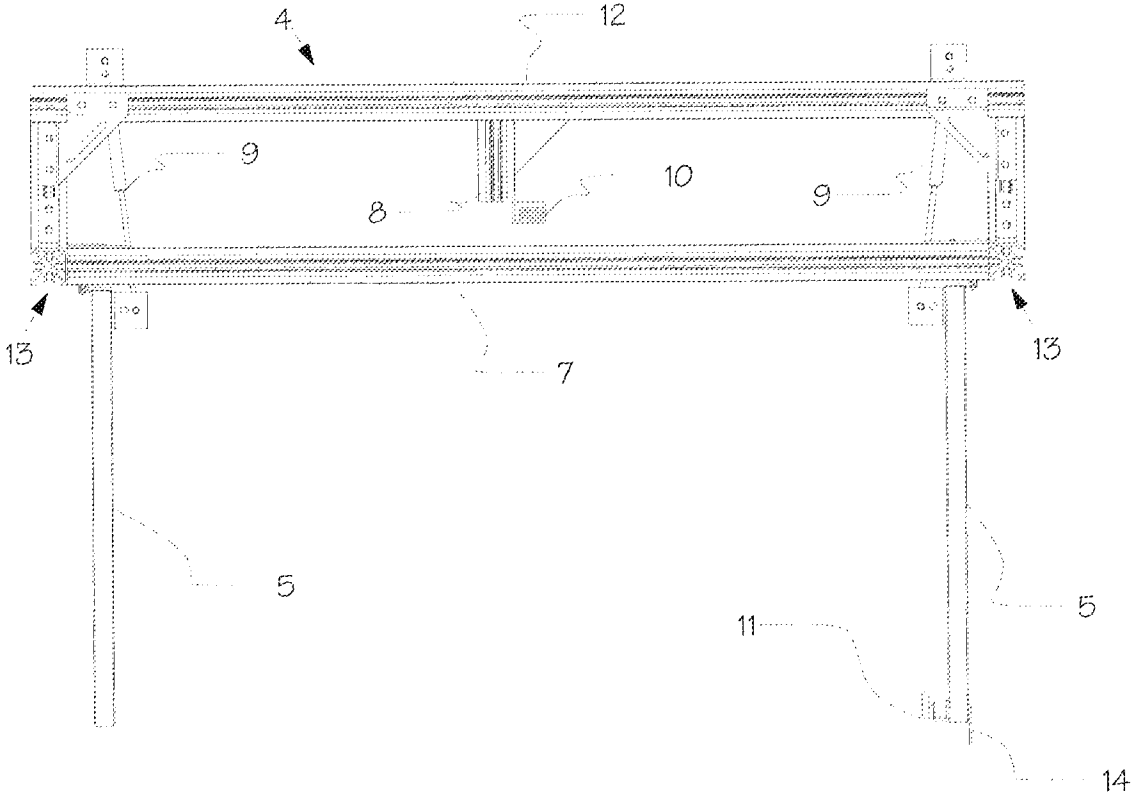
FIG. 7 is an end view of the drop panel unit of the invention in an installed orientation, and shown with the drop panels of the drop panel unit having a vertical orientation.

FIG. 6 is an end view of the drop panel unit 4. In FIG. 6 the drop panels are shown in a horizontal orientation. As can be more clearly seen in FIG. 6, the end of the damper attached to the drop panel is near the hinge 13 and the end attached to the mounting beam 12 is substantially directly above the end of the damper that is attached to the drop panel. With such placement, when the panels are in the vertical orientation the extended, dampers are disposed near edges of the opening in order to increase the unobstructed area of the opening. This can clearly be seen in FIG. 7 which is an end view of the drop panel unit 4. In FIG. 7 the drop panels are shown having a vertical orientation.

In FIG. 7, the overlapping molding 14 can clearly be seen. As mentioned above, the overlapping molding along the unhinged edge of the drop panel allows use of a single electromagnet to hold two drop panels in the horizontal orientation. Although the use of the overlapping molding is shown, practice of the invention is possible with an electromagnet used for each drop panel, and no overlapping molding.

Figure 8:
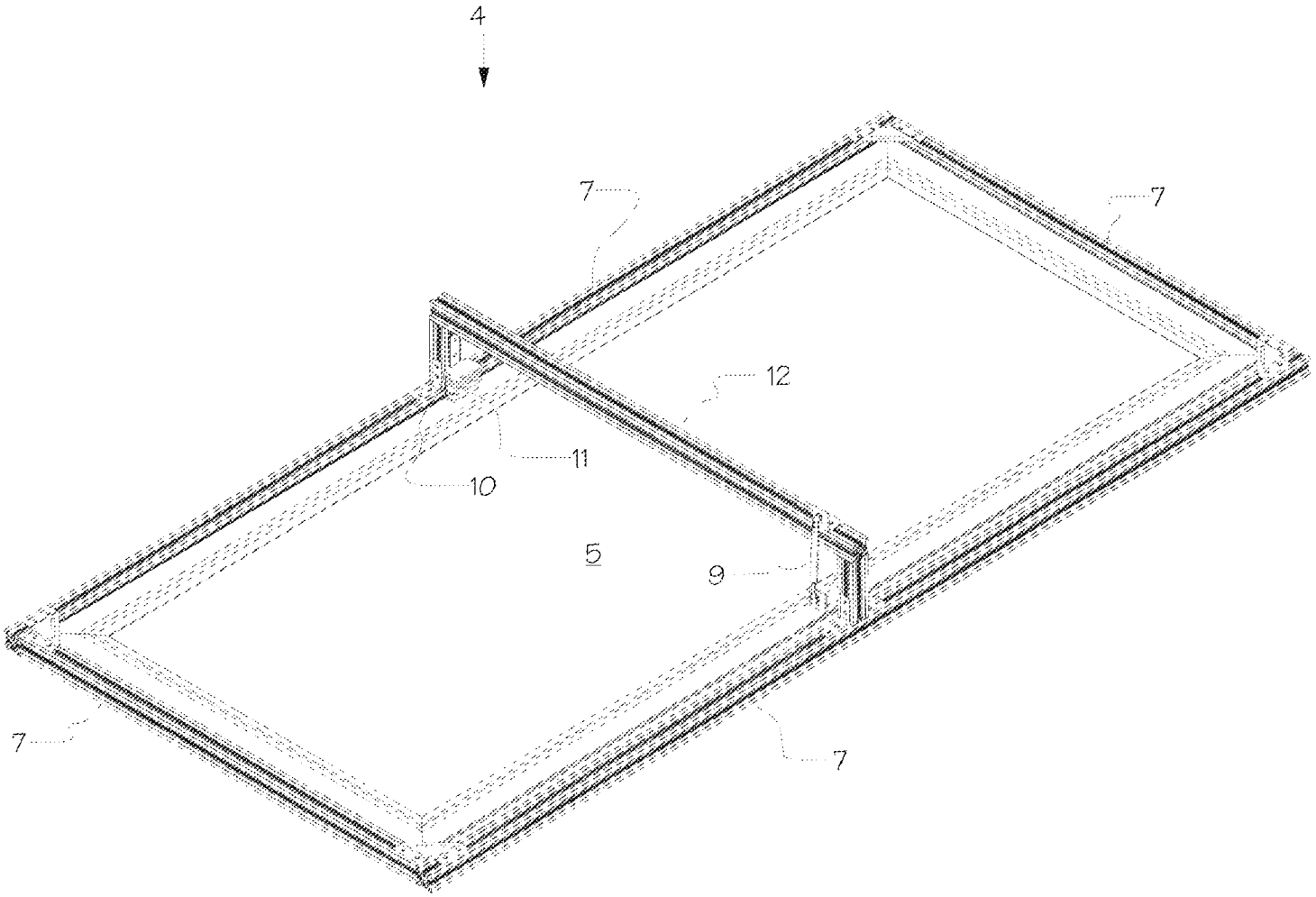
FIG. 8 is a perspective view of a single panel drop panel unit of the invention in an installed orientation, as viewed from above the drop panel unit, and shown with the drop panel of the drop panel unit having a horizontal orientation.

Also, a single drop panel is possible in practice of the invention. FIG. 8 is a perspective view of a single panel drop panel unit of the invention in an installed orientation, as viewed from above the drop panel unit, and shown with the drop panel of the drop panel unit having a horizontal orientation. As shown in FIG. 8, in an embodiment having a single drop panel, one edge of the drop panel is hinged to one side of the frame 7 and the drop panel extends across the entire drop panel opening to the opposing side of the frame 7. In the single panel embodiment of FIG. 8, damper 9 is disposed between mounting beam 12 and the drop panel 5 near the hinged edge of the drop panel, and electromagnet support 8 is disposed between mounting beam 12 and the drop panel 5 near the unhinged edge of the drop panel.

The present invention is not limited to the above-described embodiments and various modifications in design, structural arrangement, or the like may be used without departing from the scope or equivalents of the present invention.

The invention claimed is:

1. A drop panel unit, arranged to form a portion of a suspended ceiling system, the drop panel unit comprising:

a frame, with sides of the frame defining a drop panel opening;

at least one pair of drop panels, each pair of drop panels comprising a first drop panel and a second drop panel, the at least one pair of drop panels having combined dimensions for completely covering the drop panel opening, each first drop panel and second drop panel having a hinge along one edge for hinging each first drop panel to one side of the frame and each second drop panel to the opposing side of the frame, to provide for the drop panels to rotate about the hinge by gravity from a horizontal orientation to a vertical orientation;

a mounting beam having end portions thereof terminating on opposing sides of the frame and extending completely across between the opposing sides of the frame, and the mounting beam being disposed to lie above and overlying the drop panel opening defined by the sides of the frame;

an electromagnetic support disposed between the mounting beam and at least one of the first and second drop panels to magnetically hold the first and second drop panels in the horizontal orientation when electric power is provided to the electromagnetic support; and a damper disposed between the mounting beam and each drop panel to slow the rotation of the drop panels from the horizontal orientation to the vertical orientation when electric power to the electromagnetic support is removed.

2. The drop panel unit of claim 1, wherein the electromagnetic support is disposed between the mounting beam and solely each first drop panel; and each first drop panel includes means for holding the second drop panel in the horizontal orientation when both drop panels are in the horizontal orientation.

3. The drop panel unit of claim 1, wherein the electromagnetic support is disposed between the mounting beam and each first and second drop panel.

4. A drop panel unit, arranged to form a portion of a suspended ceiling system, the drop panel unit comprising:

a frame, with sides of the frame defining a drop panel opening;

a single drop panel, having dimensions for completely covering the drop panel opening, the drop panel having a hinge along one edge for hinging the drop panel to a side of the frame, to provide for the drop panel to rotate by gravity from a horizontal orientation to a vertical orientation;

a mounting beam having end portions thereof terminating on opposing sides of the frame and extending completely across between the opposing sides of the frame, and the mounting beam being disposed to lie above and overlying the drop panel opening defined by the sides of the frame;

an electromagnetic support disposed between the mounting beam and the drop panel to magnetically hold the drop panel in the horizontal orientation when electric power is provided to the electromagnetic support; and a damper disposed between the mounting beam and the drop panel to slow the rotation of the drop panel from the horizontal orientation to the vertical orientation when electric power to the electromagnetic support is removed.

* * * * *